US006463011B1

(12) United States Patent
Christen et al.

(10) Patent No.: US 6,463,011 B1
(45) Date of Patent: Oct. 8, 2002

(54) ANALOG DISPLAY HOROLOGICAL PIECE INCLUDING MEANS FOR SELECTING DIGITAL INFORMATION

(75) Inventors: Michel Christen, Yverdon-les-Bains; Jean-Jacques Born, Morges, both of (CH)

(73) Assignee: Asulab S.A., Bienne (CH)

( * ) Notice: Subject to any disclaimer, the term of this patent is extended or adjusted under 35 U.S.C. 154(b) by 1132 days.

(21) Appl. No.: 08/558,502

(22) Filed: Nov. 16, 1995

(30) Foreign Application Priority Data

Dec. 1, 1994 (CH) ..... 3628/94

(51) Int. Cl.[7] ..... G04B 23/02
(52) U.S. Cl. ..... 368/69
(58) Field of Search ..... 368/80, 223, 229, 368/233, 69

(56) References Cited

U.S. PATENT DOCUMENTS

| | | | | |
|---|---|---|---|---|
| 4,055,755 A | * | 10/1977 | Nakamura et al. | 368/223 |
| 4,257,115 A | | 3/1981 | Hatuse et al. | |
| 4,552,464 A | * | 11/1985 | Rogers | 368/10 |
| 5,465,239 A | * | 11/1995 | Koch | 368/80 |
| 5,508,980 A | * | 4/1996 | Koch | 368/80 |

FOREIGN PATENT DOCUMENTS

| | | |
|---|---|---|
| DE | 4302023 | 7/1994 |
| GB | 2207262 | 1/1989 |

OTHER PUBLICATIONS

Patent Abstracts of Japan, vol. 10, No. 294 (P–504), Oct. 7, 1996 & JP A–61 111485, May 29, 1996.

Patent Abstracts of Japan, vol. 7, No. 6 (P–167), Jan. 11, 1983 & JP A–57 163890, Oct. 8, 1982.

* cited by examiner

*Primary Examiner*—Bernard Roskoski
(74) *Attorney, Agent, or Firm*—Sughrue Mion, PLLC

(57) ABSTRACT

Analog display horological piece, comprising at least a step by step motor (18, 20) driving hands (MN, H) for displaying a time keeping information; means of controlling said step by step motor; position detectors (51–62) providing in angular sector defined on the piece, the activation of each of said position detectors enabling the selection of a predetermined digital piece of information (0–9, ×, ÷, +, −, =); means (36, 40) for inputting said selected digital piece of information; and means (22) for processing said digital information. The control means are adapted so that at least one of said hands (MN, H) is driven so that it indicates the angular sector corresponding to the position detector (51–62) which is activated so as to confirm the selection of the digital piece of information (0–9, ×, ÷, +, −, =).

6 Claims, 5 Drawing Sheets

A)
TIME
KEEPING
MODE
B)
TIME
CORRECTION
pressure
C)
PROCESSING
MODE
D)
5
E)
F)
5-
pressure

ANALOG DISPLAY HOROLOGICAL PIECE INCLUDING MEANS FOR SELECTING DIGITAL INFORMATION

BACKGROUND OF THE INVENTION

The present invention concerns an analog display horological piece including position sensors provided on the piece for the selection of predetermined digital information, input means for each selected digital piece of information and means for processing said digital information. The invention may be used in a wrist watch provided with a calculator, a system for composing telephone numbers or another device which requires the selection and input of digital information. The invention will therefore be disclosed in the context of one of these particular applications. However, it will be appreciated that the invention is not limited to this application.

The provision of an analog display wrist watch including position sensors provided around its periphery is already known. Such an arrangement is used in the case of a wrist watch which, as well as a time display, comprises a non-time keeping device, such as a calculator. In this case, position captors may be used to select and input, digital information corresponding to the numerals 0 to 9 and the functions ×, ÷, +, − and =. Each position sensor is associated with a different digital piece of information. The activation of a position sensor, for example by the application of a pressure on its surface, enables the user to select the numeral or function associated with this sensor. Thereafter, this digital piece of information may be entered and processed by a processing circuit forming part of the calculator. The result of the processing is displayed by means of a liquid crystal display incorporated in the wrist watch.

SUMMARY OF THE INVENTION

An aim of the invention is to provide an analog display horological piece including position sensors which enables the selection of digital information in a clear, readable and intelligible manner so as to guarantee to the user that the manipulation of this piece is facile and without risk of error.

Another aim of the invention is to provide an analog display horological piece including position sensors having a simple construction and operation.

Yet another aim of the invention is to provide a horological piece which is dependable, inexpensive and able to process one or several digital pieces of information which are selected by means of these position sensors.

With this in mind, the object of the invention is an analog display horological piece, comprising at least a stepping motor driving time information display hands, means for controlling said stepping motor, position sensors provided in defined angular sectors on said piece, the activation of each of said position sensors enabling the selection of a predetermined digital piece of information, means for entering said selected digital piece of information and means for processing digital information, characterized in that said control means are adapted so that at least one of said hands is driven so that it indicates the angular sector corresponding to said activated position sensor to confirm the selection of said digital piece of information.

Due to these characteristics, the invention enables the realisation of a horological piece including position sensors which provide the user with a visual confirmation of the digital information which has been selected in a way which is clear and simple and which facilitates the manipulation of the horological piece.

According to a particular embodiment, the position sensors are arranged on the piece at positions corresponding to the indications of a classical time display.

According to another particular embodiment, the position sensors are arranged at positions corresponding to the indications of one o'clock to nine o'clock enabling respectively the selection of the numerals 1 to 9.

Other characteristics and advantages of the invention will become clear from the description which now follows, provided solely as an example, and made with reference to the annexed drawings in which:

BRIEF DESCRIPTION OF THE DRAWING

FIG. 1 represents, by way of example and in a schematic manner, a schematic diagram of a position counter incorporated in the schematic diagram of FIG. 1;

DESCRIPTION OF PREFERRED EMBODIMENTS

Figure 1:
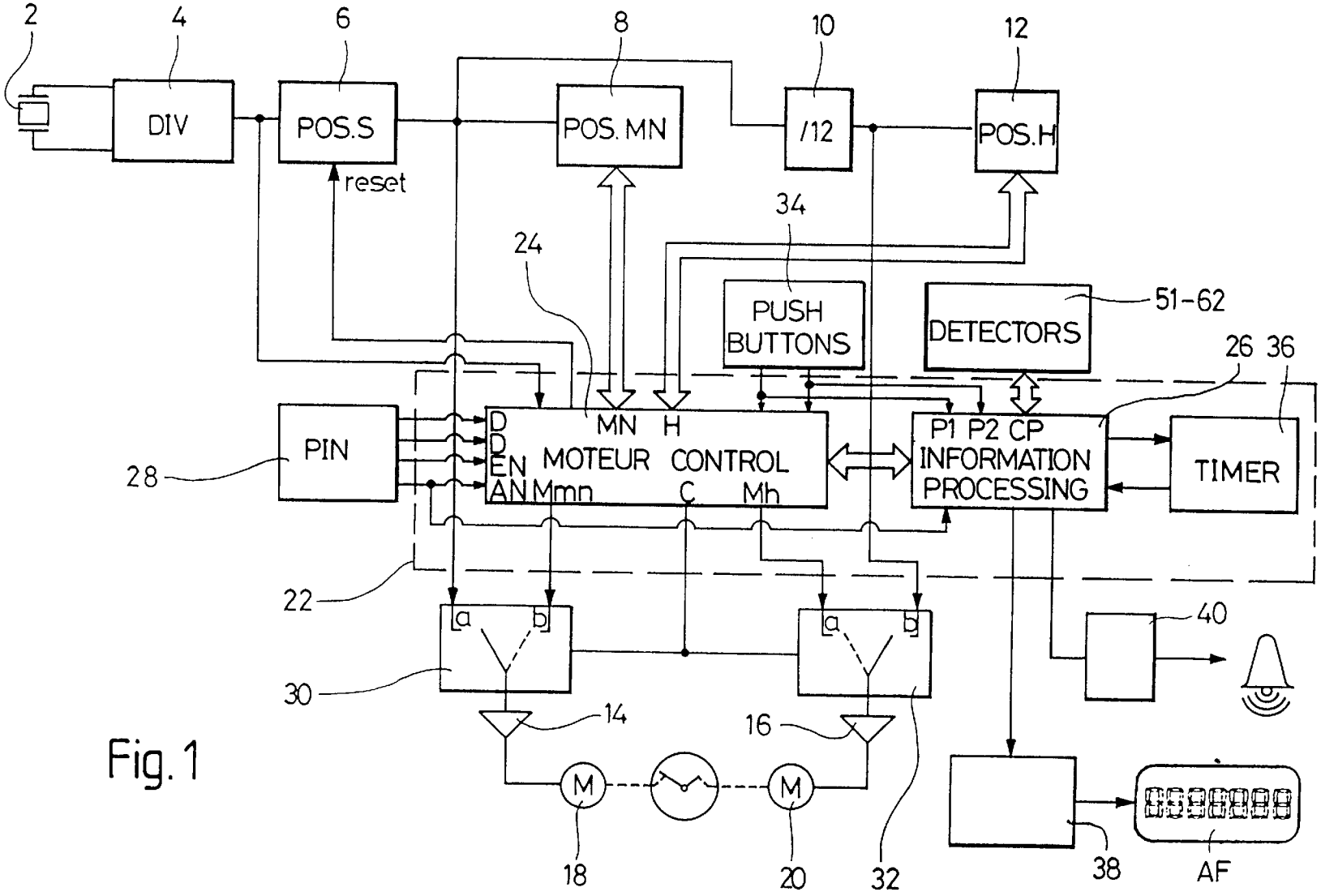
FIG. 1 represents, as an example and in a schematic manner, an analog display horological piece according to the present invention.

There is thus represented in FIG. 1, in the form of a schematic diagram, a horological piece, for example a watch, constituting an embodiment of the present invention.

As can be seen in FIG. 1, the horological piece according to the invention comprises, in series, a quartz of oscillator 2, a frequency divider 4 providing a one Hz signal, a second counter, referenced 6, and minute hand position counter, referenced 8.

The horological piece further comprises a divider-by-twelve, referenced 10, receiving the signal from the counter of the position of the second hand 6, and an hours-hand position counter, referenced 12, whose input is connected-to the output of the divider 10. The counters 6, 8 and 12 are counters-by-sixty whose mode of operation is represented schematically in FIG. 2.

Figure 2:
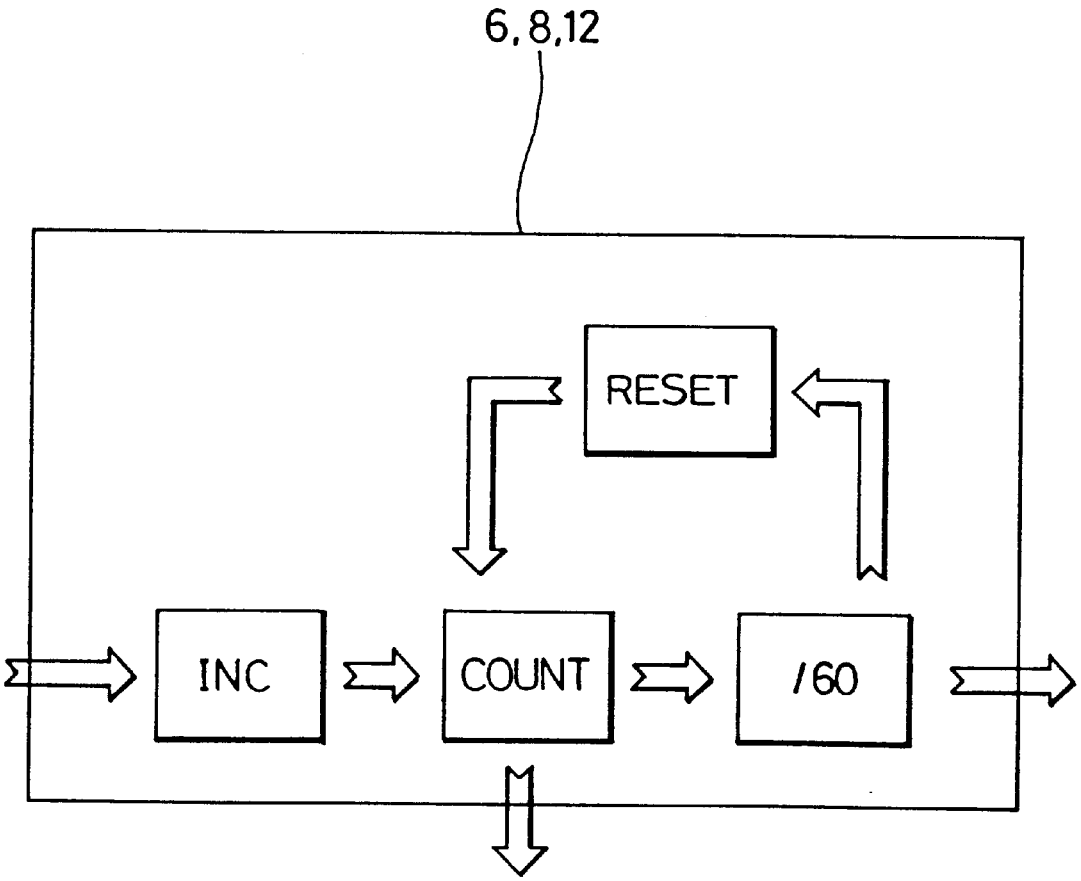

As can be seen in FIG. 2, pulses are provided to the counters (left-hand arrow on the drawing). These successive pulses are counted by a binary register of at least six bits, so that the value increases. The state of this register may be read at any moment (arrow at the bottom of the drawing). At each incrementation, the register is tested by a circuit to see if the number which it contains is equal to sixty. If this is the case, a pulse is emitted by the test circuit and this pulse causes the reset of the register. The test circuit thus constitutes a divider-by-sixty whose signal may be emitted to another counter (right-hand arrow on the drawing), which may be the counter 6, 8 or 12).

The counters 8 and 12 (FIG. 1) characterise, in a normal operating mode, that is to say a normal time-keeping mode, the position, defined according to sixty steps, of the minutes and hours hands around of the horological piece. This second counter serves solely to supply a signal whose frequency enables the incrementation in an appropriate manner the other counters 8 and 12.

Figure 3:
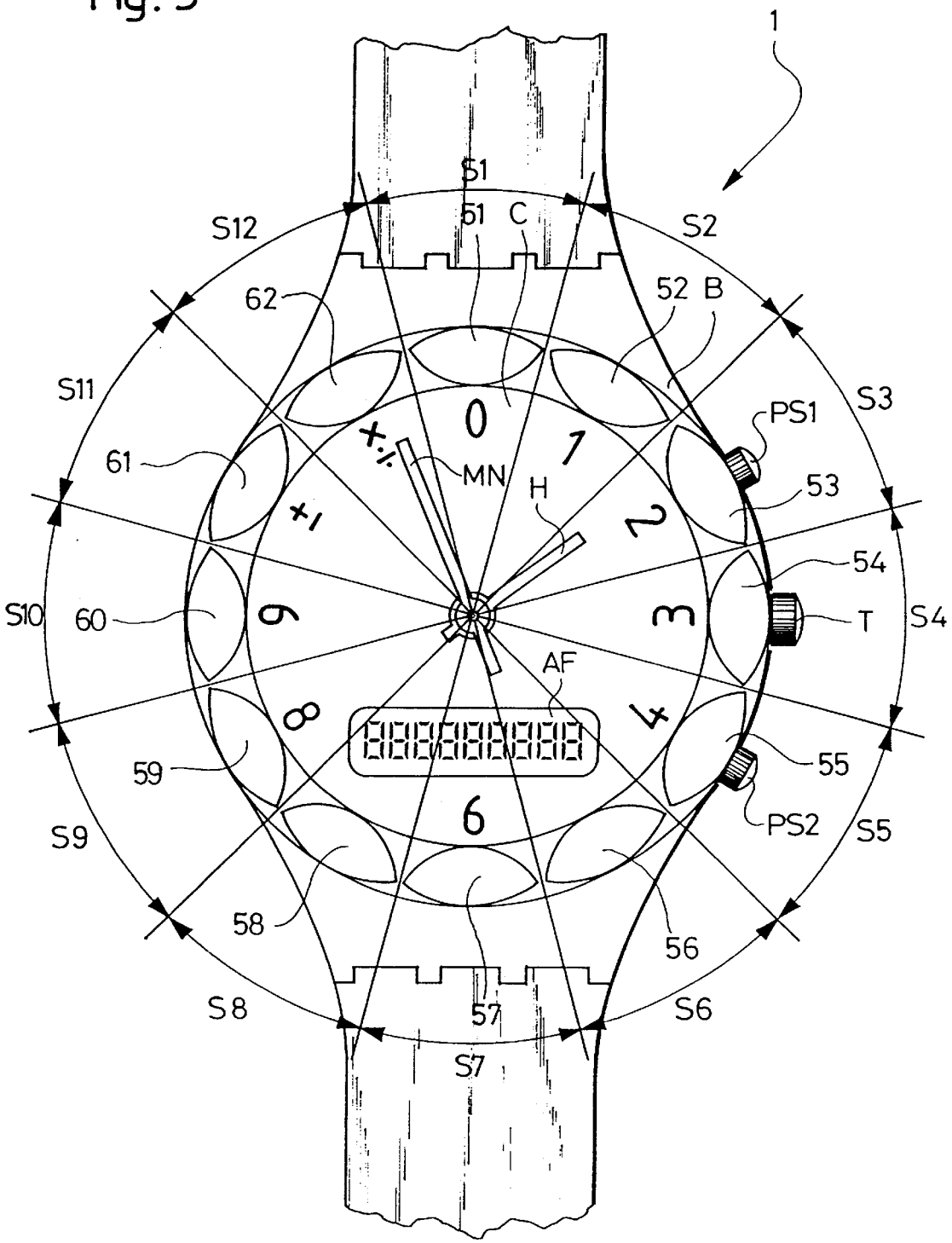
FIG. 3 is a plan view of a horological piece according to a particular embodiment of the invention and, FIGS. 4*a* and 4*b* represent a flow chart of different functions carried out by a horological piece according to the present invention, this piece incorporating the schematic diagram of FIG. 1.

This horological piece is furthermore provided with two motors 18 and 20 being able to be controlled independently respectively by the power circuits 14 and 16 to respectively drive the minutes hand MN and the hours hand H (FIG. 3).

The circuits 14 and 16 receive, in normal time-keeping mode, the pulses applied respectively to the inputs of the position counters 8 and 12 of the minutes and hours hands.

The location of the motors and the gear-trains of the present horological piece will not be described here. In fact, horological movements are already known which comprise several motors to individually operate the hands. The patent EP 0 393 606 in particular describes a horological movement comprising two motors capable of independently driving the minutes hands and the hours hands.

The elements which have just been described explain the operation of this essentially analogical horological piece as it concerns the normal display of time. However, in line with the present invention, the analog watch described here may also be used to select, enter and process digital information and then control the operation of a non-time keeping device incorporated in the watch.

The elements of FIG. 1, which will now be described, enable the performance of these specific functions.

As can be seen on FIG. 1, the horological piece according to the invention comprises electronic control means 22 comprising means of controlling stepper motors 24 to enable them to fulfil various time display functions and means for processing digital information 26 to enable the horological piece to fulfil a processing function of one or several pieces of digital information. The control means 24 include inputs MN and H for receiving the contents of the counters 8 and 12 of the position of the minutes and hours hands, two activation inputs AN, EN and two inputs $D^+$, $D^-$ for data relating to the movement of the hands respectively in the forwards and the reversed directions.

The signals applied to the input AN, EN, $D^+$ and $D^-$ are supplied by a circuit 28 which interprets the position and the displacement of a control pin, referenced T and represented in FIG. 3. The operation of the control pin T and the interpretation circuit 28 will not be described in detailed here since a skilled person already knows devices of, this type. The patent EP 0 175 961 in particular describes a control pin associated with an interpretation circuit which may easily be adapted to be used with the horological piece presently described.

The control means 24 also include two outputs Mmn and Mh to provide pulses to motors 18 and 20, and a control output C for controlling the state of two commutators 30, 32 located at the input of the power circuits 14, 16 and adapted to transmit thereto, either the pulses applied to the inputs of the position counters of the minutes hand and the hours hand when the commutators are in a first position 8 and 12 referenced a in FIG. 1, or the pulses delivered by control means 22, when the commutators are in a second position, referenced b.

The electronic control means 22 may be advantageously realised in the form of an integrated circuit comprising a programmed micro-computer. A skilled person will know, from the indications provided here, how to realise the programming of the micro-computer in a way to enable him to perform the described functions.

In the normal time keeping display mode, the control means are inactive and the motors 18 and 20 receive the pulses applied to the inputs of the position counters 8 and 12 respectively of the minutes and hours hands.

Referring now to FIG. 3, there will be hereinafter described an embodiment of the horological piece according to the invention, and in particular its means enabling the selection and the input of digital information for processing by the electronic control means 22 in none horological tasks.

The horological piece 1 includes, in a classical manner, a case B, as well as a control pin T of which is represented here only the crown.

The horological piece 1 further includes a dial C on which is provided a classical time display (non referenced) including the indications 0 (in the classic twelve hour position) to 9, inscribed in the clock wise direction around the dial C. In addition, the horological piece 1 includes a first hand, here the hours hand H, and a second hand, here the minutes hand MN.

Furthermore, the horological piece 1 includes position detectors 51 to 62. The placement of a finger of a user of the horological piece 1 on one of the positions detectors 51 to 62 causes the emission by this captor of a signal towards the digital information processing means 26. Details of the construction and the operation of the position detectors 51 to 62 will not be described here in detail since a skilled person is already familiar with detectors of this type. The patent CH 623 195 in particular described a capacitive sensor associated with a watch being able to easily be adapted for use with the horological piece presently described.

As can be seen in FIG. 3, the position detectors 51 to 62 are respectively provided in the angular sectors Si to S12 defined on the horological piece 1. It will be noted that the position detectors 51 to 62, in the example shown in FIG. 3, are at positions corresponding to the indications of a classical time display.

The dial C includes the indications 0 to 9 which are respectively at positions corresponding to the indications 12h (mark 0) to 9h of the classic time display. Furthermore, the dial C includes indications + and –, which correspond to the indication 10h of the classical time display, and the indications × and ÷ which correspond to the indication of 11h of the classical time display.

The horological piece 1 further includes two push buttons PS1 and PS2, provided in a classical manner on the two sides of the pin T.

In addition, the horological piece 1 includes a display device AF for displaying digital information. The display device AF may be realised, for example, in the form of a crystal liquid display.

In the example represented, the position detectors 51 to 62 are advantageously provided on the watch case B around the dial C, and in a non limitative manner, on the glass, preferably fixed. The position detectors 51 to 52 may furthermore be provided on a glass, non represented, or elsewhere on the horological piece 1.

Figure 4A:
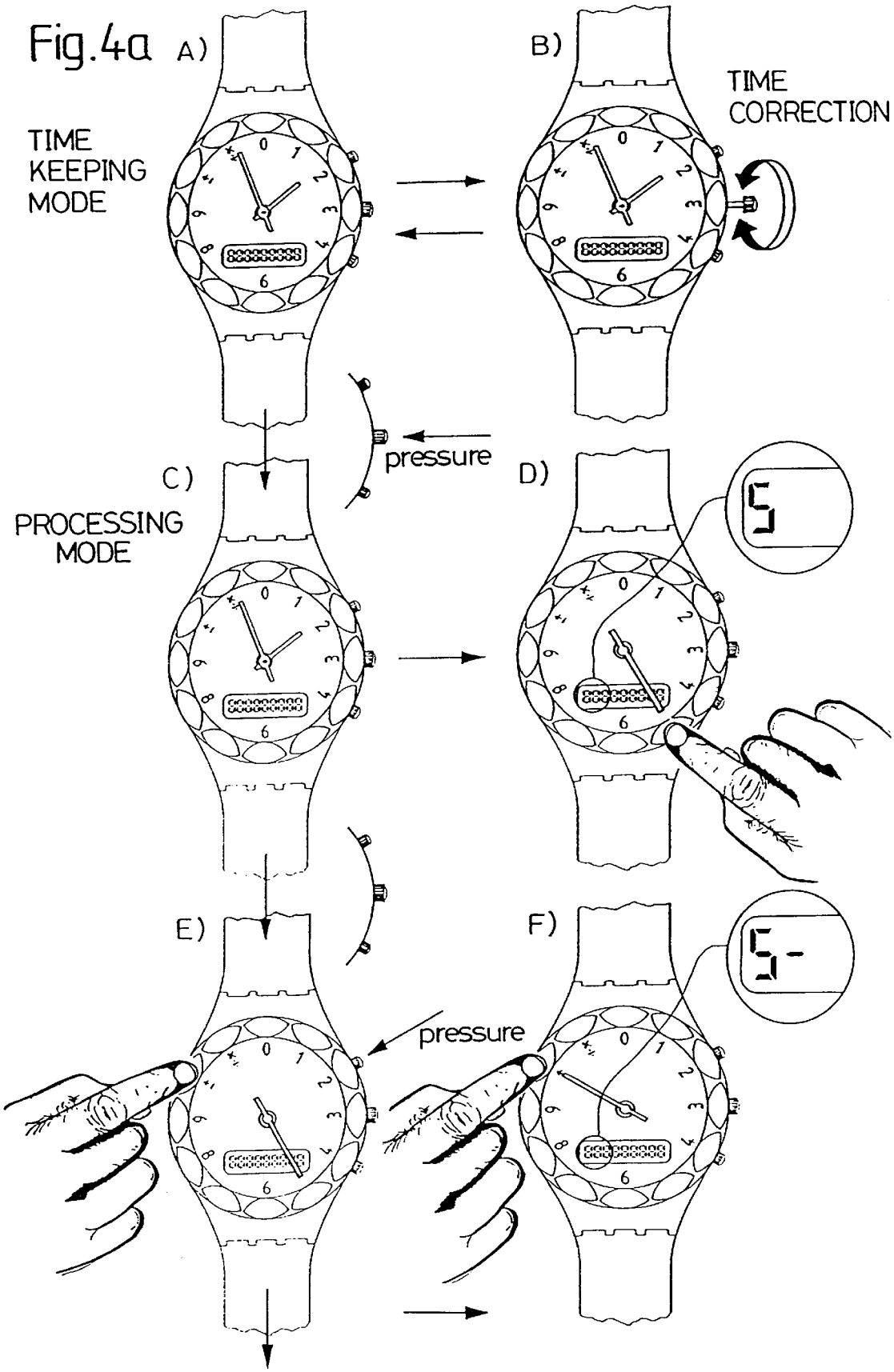
Figure 4B:
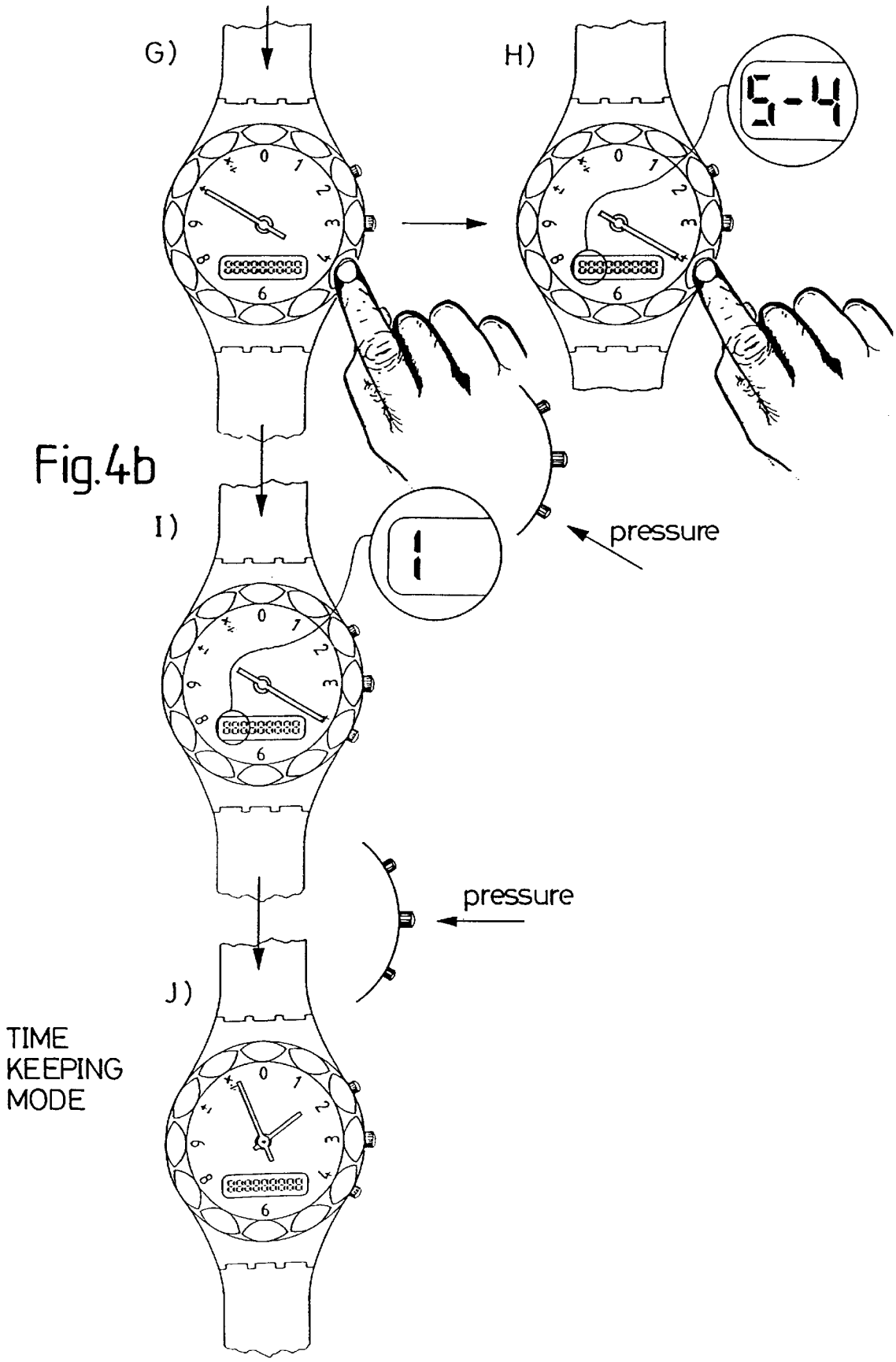

The table or flow chart of FIGS. 4*a* and 4*b* includes ten drawings or steps (referenced A to J) representing different functions being able to be fulfilled by the watch according to the invention.

Time Setting

The elements which have just been described enable the correction of the displayed time by the hands (which corresponds to the step B on the table of FIG. 4*a*).

When a watch is in the normal time display mode (illustrated in step A), the time correction function is activated by pulling on the pin (step B). The displacement with the exterior of the pin (causes the emission by the interpretation circuit 28 (FIG. 1) of a signal towards the input EN of the motor control means 24. The reception of this signal by the motor control means 24 causes the passages of the commutators 30 and 32 into the state b. Simultaneously, the control means 24 of the motors emit a high signal on the reset line of this second counter, referenced 6, to maintain its content at zero so that it will no longer supply the incrementation signal to the position counter 8 and 12 respectively of the minutes and hours hands.

The interpretation circuit 28 then sends pulses corresponding to different rotational movements in part to the pin by the user, towards the input $D^+$, $D^-$ of the motor controls 24 which, in turn emit control pulses for increasing or decreasing the position counters 8 and 10 of the minutes hand and hours hand and for simultaneously controlling the motors 18, 20 in order to displace the hand. At the end of the time-correction operation, the pin is pushed (step A), the interpretation circuit 28 sends a deactivation signal to the motor control means 24 which in turn supply a signal at their output C to pass the commutators 30, 32 into the state a. Simultaneously, the signal on the reset line returns to zero and the second counter 6 restarts.

Digital Information Process in Mode

As has been previously mentioned, the horological piece described here is intended to perform a supplementary function, called a processing function.

To this effect, the digital information processing means 26 include an input CP for receiving the output signals of the position detectors 51 to 62 and two inputs P1 and P2. The signals applied to the inputs P1 and P2 are supplied by a second interpretation 34 of the displacement respectively of the push buttons PS1 and PS2.

When a user places his finger on one of the position detectors 51 to 62, a signal in a high state is sent to the digital information processing means 22. These signals present at the outputs of the other position detectors are in a low state. Thus, the output signals of the position detectors 51 to 62 correspond, at the input CP, to a binary value representing the position detector which is activated. The digital information processing means 26 are adapted to convert this binary value into a value between one and sixty corresponding to the positions which are characteristics of the hours and minutes hands on the dial C so that they are superposed and indicate one of the angular sectors S1 and S12.

The electronic means 22 further include a temporisation circuit 26 which is intended to send a confirmation signal to the digital information processing means 26 at the end of a determined period after an activation signal is received by this latter.

In addition, the horological piece 1 includes a control circuit 38 for controlling the display device AF. The control circuit 38 receives signals corresponding to the digital information to be displayed, which comes from the digital information processing means 26.

These digital information to be displayed are then sent to the display device AF for display.

In the examples represented in FIGS. 1 and 3, the horological piece according to the invention further include an acoustic signal synthesiser circuit referenced 40, which is connected to the electronic control means 22. This circuit is activated at chosen moments during the inputs steps of the digital information by the user.

Entry in Processing Mode

When the watch is in the normal time display mode, and the interpretation circuit 24 (FIG. 1) emits, in the direction of the input AN of the electronic control means 22, an activation signal corresponding to a pressure applied to the pin, the electronic control means 22 emit a signal at their output C to place the commutators 30 and 32 in the state b (FIG. 1), that is to say to block the pulses coming from the counter 8 and 12. Simultaneously, the electronic control means 22 read the contents of counters 8 and 10 to know the position of the minutes and hours hands. The selection of the digital information is made by the user of the horological piece 1 by activating the position detector corresponding to this piece of digital information (step C). For example, if the user wish to select, firstly, the digital piece of information "5", he places his finger on the position detector 56 in the angular sector S6. The binary value presented to the input CP is read by the digital information processing means 26 and is then converted into a value corresponding to the positions of the hours and minutes hands on the dial C so that they indicate the number "5" in the angular sector S6.

The digital information processing means 26 send this latter value to the motor control means 24 so that they thus emit the required number of pulses at the output Mmn and Mh to bring the hands to superpose themselves in the angular sector S6 to enable the display of the digital piece of information "5" on the dial, as is shown in step D of FIG. 4. This display thus corresponds to a confirmation of the selection of the digit "5" and enables the user to select the desired digital information in a simple and efficient manner.

The confirmation of the selection of digital information in the processing mode by the two superposed hands on the dial is thus immediately perceptible in a clear manner by the user. Furthermore, it should be noted that this configuration of hands is unusual in this region of the dial and can in no case by confused with an indication of the time.

It will also be noted here that in the case of the embodiment represented in FIGS. 4*a* and 4*b*, the hands indicate a particular digital piece of information in a superposed state so that the confirmation it provides is clear. However, it is possible to confirm its selection of a digital piece of information by only using one of the hands of the horological piece 1.

After the selection of a digital piece of information by the activation of one of the position detectors 51 to 62 by the user, the digital information processing means 26 send a signal corresponding to this information to the control circuit 38 for the display of the information by the display device AF. In the case represented in step D of FIG. 4*a*, the digital information "5" is displayed to provide a supplementary confirmation of the selection of the digit "5" by the user.

When the user activates one of the position detectors 51 to 62, the digital information processing means 26 sends a signal in a high state to the temporisation circuit 36. Whilst the captor activated is the same, this signal remains in a high state, and the temporisation circuit 36 starts counting time minute. For example, if the user activates another position detector, a pulse in a low state is sent by the digital information processing means 26 to the temporisation circuit 36 and this latter is reset to zero before recommencing its operation.

After the activation of one of the position detectors 51 to 62, the digital information processing means 26 remain in a wait mode until they have determined, thanks to the temporisation circuit 36, that a predetermined period of the time, for example one second, has passed since this operation.

The digital information processing means 26 consider, in this case, that the user has selected a desired piece of digital information and thus record a value corresponding to this digital piece of information in a memory (non represented) for processing. At the moment of this recording, the digital information processing means 26 activate the control circuit to 40 so that an acoustic signal is emitted. The input of the selected digital piece of information is thus indicated to the user, who may than proceed to select an input the next digital piece of information.

In the example shown in FIG. 4*a*, this next step is the selection and the input of the digital piece of information "–". The operation of the push button PS1 sends a pulse to the digital information processing means 26 so that they can detect the difference between the indication of the four digital pieces of information associated to these two angular sectors 61 and 62 ("+" and "–" in the angular sector 61 and "×" and "÷" in the angular sector 62).

The operation of the push button PS1 followed by the placement of the finger of the user on the position detector 61 indicates to the digital information processing means 26 the selection of the digital piece of information "–". If the push button PS1 is not activated before the placement of the finger on the position detector 61, this placement is operated by the digital information processing means 26 has being the selection of the digital piece of information "+".

Similarly, the activation of the push button PS1 followed by the placement of the finger of the user on the position detector 62 is interpreted as being the selection of the binary piece of information "×+ whilst the placement of the finger on the position detector 62 without operating the push button PS1 is interpreted as being the selection of the digital piece of information "÷".

Thus, at step E of FIG. 4*a*, the user operates the push button PS1, and then places his finger on the position detector 61 to select the digital piece of information "–".

The binary value present at the input CP is read by the digital information processing means 26 and is then converted into a value corresponding to the position of the hours and minutes hands on the dial C so that they indicate the operator "–" in the angular sector 11. The digital information processing means 26 send this latter value to the motor control means 24 so that they thus emit the required number of pulses at the output Mmn and Ml to bring the hands into a superposed position in the angular sector S11 to confirm the selection of the digital piece of information "–" (step F). At the same time, the digital piece of information "–" is displayed by the display device AF to provide a supplementary confirmation of the correct selection of the operator "–" by the user.

After one second has passed, measured by the temporisation circuit 36, to which the position detector 61 has been operated, the digital information processing means 26 record a value corresponding to this digital piece of information in the memory (non represented) for processing. At the moment of this recording, the digital information processing means 26 activates the control circuit 40 so that a second acoustic signal is emitted to indicate to the user the input of this digital piece of information.

In steps G and H in FIG. 4*b*, the binary piece of information "4" is selected and then inputted, in the above described manner for steps C and D.

Next, the result of the operation "5-4" made in step C and H, is calculated by the digital information processing means 26 whilst the push button PS2 is activated. The result is displayed due to the display device AF. Finally, as soon as a pressure has been applied to the pin marking the disactivation of the processing mode "step J), the watch returns to its time display mode (step A).

Finally, it should be noted that several modifications may be made to the horological piece according to the invention without departing from the contact thereof. For example, the present invention, may be used in a device which includes a telephone or other means of communication necessiting the selection and input of numbers to be called.

What is claimed is:

1. An analog timepiece comprising:

a dial divided into a plurality of angular sectors corresponding respectively to a plurality of predetermined pieces of information provided on said timepiece;

at least one stepping motor arranged to drive at least one hand of the timepiece;

a plurality of position sensors individually disposed around a periphery of said dial, each position sensor corresponding to a different one of said angular sectors, and each position sensor being manually activatable to enable selection of a corresponding piece of information;

means responsive to the activation of a selected position sensor for controlling said stepping motor to drive said hand into the angular sector corresponding to the selected position sensor, and attendantly a corresponding piece of information, so that a user of said timepiece can visually check correctness of the actual selected piece of information; and means, manually activatable by the user, for validating a correct piece of information and for providing to a processing means a validation signal of a correct selected piece of information.

2. The timepiece according to claim 1, wherein said position sensors are located on the timepiece at positions corresponding to classical hour display indications.

3. The timepiece according to claim 2, wherein the position sensors are located at positions corresponding to the indications one o'clock to nine o'clock enabling respectively the selection of the numerals 1 to 9.

4. The timepiece according to claim 1, further comprising supplementary display means for displaying said selected piece of information.

5. The timepiece according to claim 4, wherein said control means are adapted so that at least said hand and an additional hand are driven so that they are superposed during the display of said selected piece of information.

6. The timepiece according to claim 1, wherein said position sensors are of a capacity type.

* * * * *